US008613570B2

(12) United States Patent
Westre

(10) Patent No.: US 8,613,570 B2
(45) Date of Patent: Dec. 24, 2013

(54) METHOD AND A KIT FOR CONSTRUCTING A SEMI-SUBMERSIBLE UNIT

(75) Inventor: Bernt Erik Westre, Torslanda (SE)

(73) Assignee: GVA Consultants AB, Gothenburg (SE)

( * ) Notice: Subject to any disclaimer, the term of this patent is extended or adjusted under 35 U.S.C. 154(b) by 127 days.

(21) Appl. No.: 12/475,653

(22) Filed: Jun. 1, 2009

(65) Prior Publication Data

US 2010/0003085 A1 Jan. 7, 2010

Related U.S. Application Data

(60) Provisional application No. 61/057,301, filed on May 30, 2008.

(51) Int. Cl.
*B63B 3/00* (2006.01)

(52) U.S. Cl.
USPC ..... 405/218; 405/200; 405/219; 114/264; 114/266

(58) Field of Classification Search
USPC ..... 405/196, 198, 200, 201, 205, 207, 210, 405/218, 219, 222; 114/65 R, 263, 264, 266, 114/267
See application file for complete search history.

(56) References Cited

U.S. PATENT DOCUMENTS

| | | | | |
|---|---|---|---|---|
| 3,659,540 | A * | 5/1972 | Toby et al. | 114/266 |
| 4,848,967 | A * | 7/1989 | Weyler | 405/204 |
| 4,907,912 | A * | 3/1990 | Smith | 405/208 |
| 4,938,632 | A * | 7/1990 | Eie | 405/223.1 |
| 6,244,785 | B1 * | 6/2001 | Richter et al. | 405/195.1 |
| 2004/0253059 | A1 * | 12/2004 | Horton, III | 405/195.1 |
| 2006/0254492 | A1 * | 11/2006 | Whybourne | 114/263 |

* cited by examiner

*Primary Examiner* — Benjamin Fiorello
(74) *Attorney, Agent, or Firm* — Gary M. Machetta

(57) ABSTRACT

A method of constructing a semi-submersible unit with a side wall. To construct the semi-submersible unit, the method can include placing a hull in a body of water and connecting a deck structure to the hull. In addition, there is a kit for constructing a semi-submersible unit, with a side wall.

16 Claims, 5 Drawing Sheets

METHOD AND A KIT FOR CONSTRUCTING A SEMI-SUBMERSIBLE UNIT

CROSS REFERENCE TO RELATED APPLICATIONS

This application claims benefit of U.S. Provisional Patent Application No. 61/057,301 filed on May 30, 2008.

BACKGROUND

Field

The present invention relates to a method of constructing a semi-submersible unit comprising a side wall, wherein the method comprises the steps of: placing a hull in a body of water, the hull comprising an opening for receiving an end piece, the end piece constituting at least a portion of the side wall; lowering the hull into the body of water, and connecting a deck structure to the hull to form a semi-submersible unit.

The present invention also relates to a kit for constructing a semi-submersible unit comprising a side wall, wherein the kit comprises hull comprising an opening and a deck structure. Moreover, the present invention relates to a semi-submersible unit constructed according to the method and/or from a kit according to the present invention.

Semi-submersible units are inter alia used for drilling for, or production of, natural resources such as gas and oil, when the natural resources for example are located in a source located at the bottom of a sea or lake. Furthermore, semi-submersible units are used for quartering staff working out at sea.

Over the years, the sizes of semi-submersible units have generally increased which results in various problems when constructing the units. For instance, there may be few, if any, dry docks available in the world adapted to accommodate a complete semi-submersible unit the displacement and load carrying capacity of which meets the requirements of a modern drilling or production unit. Moreover, semi-submersible units are often provided with a deck structure adapted to accommodate e.g. drilling or production equipment and such a deck structure is often too heavy and/or large to be lifted by conventional lifting arrangements, such as cranes.

Furthermore, within the field of semi-submersible units, there has recently been an interest in units comprising a side wall or, even more preferred, being provided with an outer wall delimiting an enclosed area within the unit wherein the outer wall substantially constitutes the hull of the unit. The latter unit may be referred to as a ring wall type of semi-submersible unit.

When constructing a semi-submersible unit of a ring wall type with a deck structure, the prior art, see e.g. WO 02/092425, proposes a method of constructing a platform structure comprising a hull structure and a self-floating deck module, which method comprises the steps of lowering the hull structure into a body of water, floating the deck module over the hull structure and connecting the hull structure with the deck module. The steps as defined hereinabove as regards the floating in and connection of the deck module is often referred to as a mating procedure. However, as may be realized by a person skilled in the art, lowering the complete hull structure as proposed by '425 requires a large amount of e.g. ballast water—due to the large water line area of the hull structure—which results in that the hull structure will be subjected to large loads. Moreover, when the '425 hull structure is lowered to a position in which the deck structure may be connected to the hull structure, only a small portion of the hull structure is intersecting a still water level, resulting in a low stability of the hull structure. As may be realized by a person skilled in the art, there is generally a desire to avoid large loads, as well as a low stability, of the hull structure during a mating procedure.

Moreover, U.S. Pat. No. 6,125,780 discloses a method of constructing a hull for a ring wall semi-submersible unit which method comprises the steps of providing four substantially identical buoyant modules and attaching them to one another to thereby form a hull of a ring wall type. However, as in the '425 case, the hull obtained using the '780 method will also exhibit a large water plane area, hence requiring a large amount of e.g. ballast water in order to lower the hull to a position in which a deck structure may be connected to the hull.

As such, as may be realized from the above, when a constructing semi-submersible unit comprising a side wall and/or which is of a ring wall type, there is a need for improving the methods by which such units are constructed.

SUMMARY OF THE INVENTION

A first object of the present invention is to provide a method of constructing a semi-submersible unit comprising a side wall, wherein no one of the components constituting the semi-submersible unit is subjected to excessive loading during the construction.

A second object of the present invention is to provide a method of constructing a semi-submersible unit comprising a side wall, which method ensures that the floating components of the unit provide an appropriately high stability during the construction.

A third object of the present invention is to provide a method of constructing a semi-submersible unit comprising a side wall, which reduces, preferably eliminates, a risk of obtaining large residual stresses in any part of the semi-submersible unit.

A fourth object of the present invention is to provide a method of constructing a semi-submersible unit comprising a side wall, which requires a minimum of construction time in a dry dock and/or at a quay.

At least one of the objects above is achieved by a method for constructing a semi-submersible unit comprising a side wall according to claim 1.

As such, the present invention relates to a method of constructing a semi-submersible unit comprising a side wall, wherein the method comprises the steps of: placing a hull in a body of water, the hull comprising an opening for receiving an end piece, the end piece constituting at least a portion of the side wall; lowering the hull into the body of water, and connecting a deck structure to the hull to form a semi-submersible unit.

According to the present invention, the method further comprises the steps of: floating the end piece into the opening, and attaching the end piece to the semi-submersible unit.

Preferably, the two last steps of the method as presented hereinabove are executed after the deck structure has been connected to the hull.

Thus, by utilizing the aforementioned method of the invention, the mating of the deck structure with the hull may be performed when the hull provides appropriate hydrostatic characteristics, such as water plane area and stability. Then, the end piece is inserted in the semi-submersible unit thus formed, wherein the introduction of the end piece will further contribute to the hydrostatic characteristics of the hull without impairing the above mentioned mating procedure.

Moreover, since the hull and deck structure are connected to one another, thus preferably forming a continuous unit prior to the insertion of the end piece, initial deflections of the hull—e.g. due to differences in the inner and outer pressure of the hull—may be reduced, or even avoided since the deck structure generally is a member with a high stiffness. As may be realized by a person skilled in the art, if the end piece was to be inserted and connected to the hull when the hull was subjected to initial deflections—this may result in residual stresses in at least a portion of the complete semi-submersible unit. These residual stresses may be reduced, or even avoided, by the construction method of the present invention.

It should be noted that the step of attaching the end piece to the semi-submersible unit need not necessarily be an additional method step, the end piece and semi-submersible unit may namely be arranged to become attached to one another on insertion of the end piece and semi-submersible unit with mating mechanical parts arranged to fasten and/or lock on insertion of the end piece into the semi-submersible unit.

It should also be noted that an end piece need not necessarily fill the entire opening but that several end pieces may be arranged to be inserted into the same opening; said one or more end pieces not necessarily filling the opening. Additionally, and end piece may itself comprise one or more openings.

According to a preferred embodiment of the method of the present invention, the method further comprises a step of elevating the semi-submersible unit after the deck structure has been connected to the hull in order to facilitate the floating in of the end piece.

According to another embodiment of the method of the present invention, the method further comprises a step of elevating the semi-submersible unit after the end piece has been inserted into the opening such that the step of attaching the end piece to the semi-submersible unit may be performed above a still water level of the body of water.

This ensures that the end piece may be attached to the semi-submersible unit by means of conventional attachment techniques, such as dry welding, which is considerably cheaper and more efficient than for instance wet welding, i.e. welding below the still water surface.

According to a further embodiment of the method of the present invention, the end piece is buoyant such that the end piece may be self-floating into the opening, preferably the end piece is towed into the opening. Thus, if the end piece is self-floating, the need for additional floating members, such as barges, during the construction of the semi-submersible unit, may be reduced, or even omitted.

According to another embodiment of the method of the present invention, the hull comprises a truss assembly at least partially delimiting the opening and the step of attaching the end piece to the semi-submersible unit in turn comprises the steps of: attaching the end piece to the truss assembly, and sealing the truss assembly from ambient water by attaching a sealing arrangement, which sealing arrangement preferably comprises a plate such as a steel plate, to the truss assembly.

The truss assembly as mentioned hereinabove, may provide additional structural stiffness to the hull—hence preferably reducing the risk for initial deflections—without substantially increasing the water plane area of the hull.

According to a further embodiment of the method of the present invention, the hull comprises guide means for guiding the end piece into the opening and the step of floating the end piece into the opening in turn comprises a step of guiding the end piece into the opening using the guide means.

According to another embodiment of the method of the present invention, the step of attaching the end piece to the semi-submersible structure in turn comprises the steps of: attaching the end piece to the hull, and attaching the end piece to the deck structure.

A second aspect of the present invention relates to a kit for constructing a semi-submersible unit comprising a side wall, wherein the kit comprises: hull comprising an opening, and a deck structure.

According to the second aspect of the present invention, the kit further comprises an end piece adapted to constitute at least a portion of the side wall, the end piece further being adapted to be floated into the opening and attached to the hull.

According to a preferred embodiment of the second aspect of the present invention, the hull comprises means for guiding the end piece into the opening.

According to another embodiment of the second aspect of the present invention, the hull comprises a truss assembly at least partially delimiting the opening.

According to a further embodiment of the second aspect of the present invention, the hull comprises a first and a second longitudinally extending float, wherein each one of the first and second floats is adapted to extend through a still water level of a body of water, wherein the first and second floats are connected to one another by means of a substantially transversally extending bridging arrangement wherein: at least a portion of the first float, at least a portion of the second float and at least a portion of the bridging arrangement at least partially delimits the opening.

According to another embodiment of the second aspect of the present invention, the end piece comprises structural tanks, such as ballast water tanks.

According to a further embodiment of the second aspect of the present invention, the hull comprises tanks adapted to store liquefied natural gas.

According to another embodiment of the second aspect of the present invention, the kit comprises a plurality of end pieces such that the side wall delimits an enclosed area.

A third aspect of the present invention relates to a semi-submersible unit constructed according to the method according to the first aspect of the present invention and/or from a kit according to the second aspect of the present invention.

BRIEF DESCRIPTION OF THE DRAWINGS

The present invention will be described in greater detail by means of non-limiting examples only and with reference to the attached drawings wherein.

DETAILED DESCRIPTION OF PREFERRED EMBODIMENTS

The invention will be described using examples of embodiments. It should however be realized that the embodiments are included in order to explain principles of the invention and not to limit the scope of the invention, defined by the appended claims.

Figure 1:
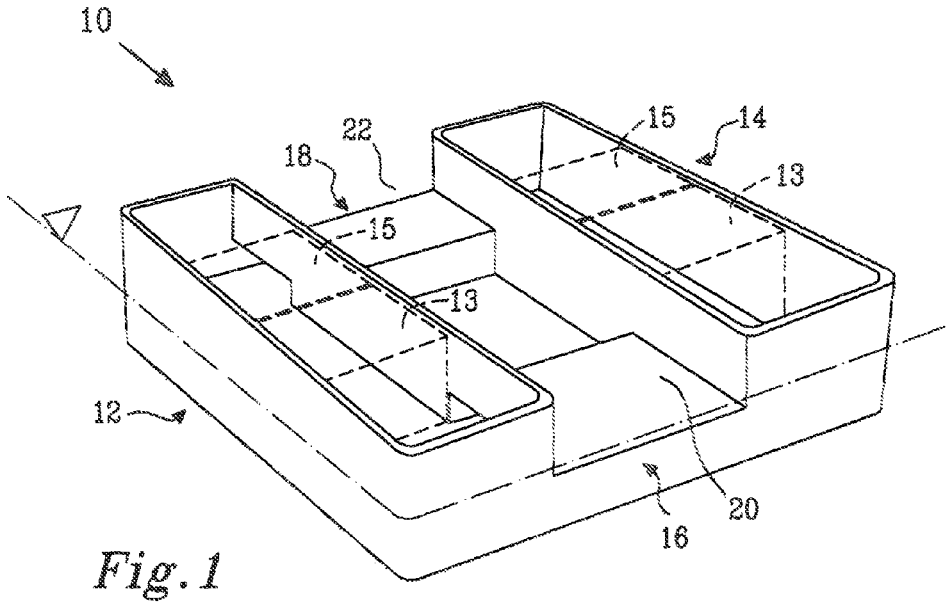
FIG. 1 illustrates a schematic perspective view of a hull comprising an opening for receiving an end piece.

FIG. 1 illustrates a hull 10 which is suitable to be used in the construction method of the present invention. The hull 10 comprises a first and a second longitudinally extending float 12, 14. Each one of the first 12 and second 14 floats is adapted to extend through a still water level (SWL) of a body of water. The first and second floats 12, 14 are connected to one another by means of a substantially transversally extending bridging arrangement, which bridging arrangement in the implementation of the hull 10 illustrated in FIG. 1 is constituted by two transversally extending bracings, namely a first 16 and a second bracing 18, wherein each one of the bracings 16, 18 connects a lower portion of the first float 12 to a lower portion of the second float 14. The floats 12, 14 and the bracings 16, 18 are preferably made out of steel. Purely by way of example, the hull 10 may have a displacement within the range of 50 000-500 000 metric tonnes when in an operational draught.

Furthermore, as may be gleaned from FIG. 1, the first and the second floats 12, 14 in combination with each one of the bracings 16, 18 form an opening in the hull. As such, the first and second floats 12, 14 and the first bracing 16 form a first opening 20 whereas the first and second floats 12, 14 and the second bracing 18 form a second opening 22.

In the presentation of the construction method of the present invention hereinbelow, reference will be made to the first opening 20 only. However, a person skilled in the art will directly realize that each step in the construction method is equally applicable for the second opening 22.

At least one, but preferably both, of the floats 12, 14 are preferably furnished with tanks for storing hydrocarbons, such as gas or oil. More preferred, the floats are furnished with tanks 13 for storing liquefied natural gas (LNG). Moreover, the floats 12, 14—and possibly also the bracings 16, 18—are provided with ballast .water tanks 15 and a ballast water system including inter alia water pumps for controlling the water level in the aforementioned ballast water tanks such that the load and hence the floating condition of the hull 10 may be controlled.

Figure 2:
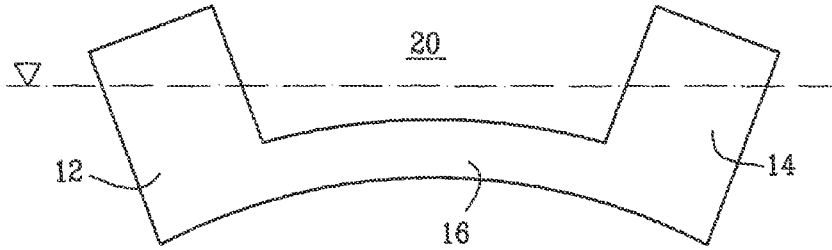
FIG. 2 illustrates a schematic side view of the hull illustrated in FIG. 1.

FIG. 2 presents a side view of the FIG. 1 hull 10, wherein deflections of the hull 10 have been exaggerated. As may be realized from FIG. 2, when the hull 10 is floating in water, there is a risk that the hull may be subjected to initial deflections due to e.g. difference in the internal pressure and the external pressure—i.e. the water pressure—of the hull 10. Moreover, FIG. 2 illustrates that it is not unlikely that the bracings 16, 18 may be subjected to a bending deflection resulting in that the first and second floats 12, 14 will be inclined away from one another. As such, if an end piece (not shown in FIG. 2), adapted to be fitted into the first opening 20 was to be attached to the hull 10 in the floating condition illustrated in FIG. 1 and FIG. 2, there is a risk that the hull 10 thus obtained—i.e. comprising the original hull 10 and the end piece—would contain residual stresses which may impair the strength of the hull 10. This problem is at least reduced by the construction method of the present invention, as will be explained hereinbelow.

Figure 3:
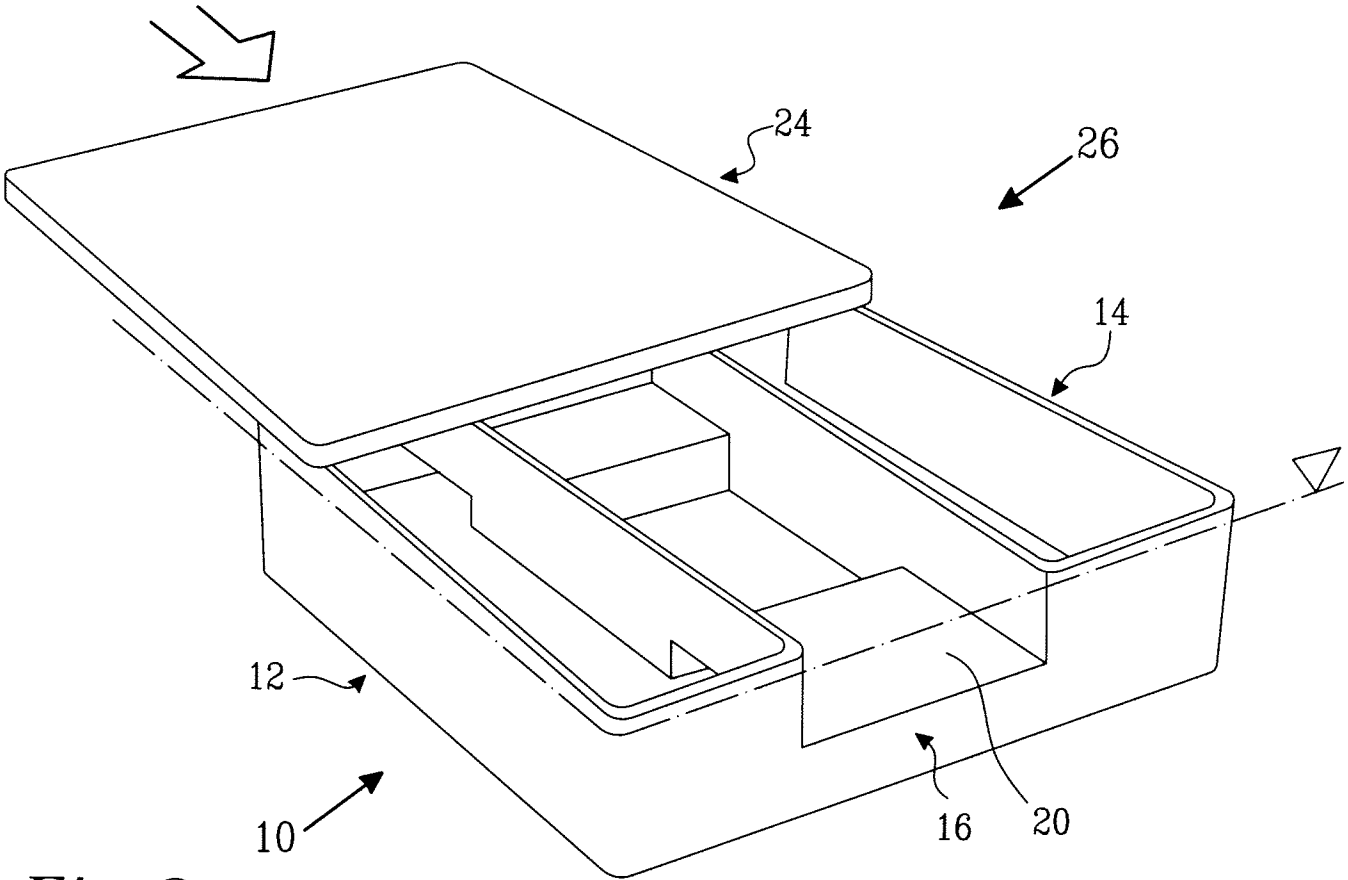
FIG. 3 illustrates a schematic perspective view of the hull of FIG. 1 as well as a deck structure in a step of the method of the present invention wherein the deck is connected to the hull to form a semi-submersible unit.

FIG. 3 illustrates a further step of the construction method of the present invention, wherein the hull 10 has been lowered into the water such that the freeboard, i.e. the distance from the still water level to the uppermost portion of the first and second floats 12, 14, is so small that a deck structure 24 may be floated over the hull 10. Preferably, the hull 10 is lowered by introducing ballast water into the hull 10, e.g. by using the aforementioned ballast water tanks (not shown). Since the water plane area of the hull 10 is only constituted by the water plane areas of the first 12 and second 14 floats, respectively, the hull 10 may be lowered to a desired draught without subjecting the hull 10 to excessive loads. Furthermore, the water plane areas of the first 12 and second 14 floats, respectively, preferably are adapted to provide an appropriate stability to the hull 10 in the floating condition illustrated in FIG. 3.

When the hull 10 is in the position illustrated in FIG. 3, the deck structure 24 is floated over the hull 10. To this end, the deck structure 24 may be loaded onto one or several barges (not shown) wherein at least one of the barges may be guided through the second opening 22 of the hull 10. Optionally, the deck structure 24 may be buoyant—for instance a centre portion of the deck structure 24 may be adapted to be immersed in water and thus carry the rest of the deck structure 24 when it is introduced through the second opening 22.

The deck structure 24 may have various designs, depending inter alia on the purpose of the semi-submersible unit to be constructed. Purely by way of example, the deck structure 24 may be a buoyant member or at least have a water tight bottom. Optionally, the deck structure 24 may comprise, or even be constituted by, a truss structure (not shown). Moreover, although the deck structure 24 in FIG. 3 is illustrated as being constituted by one single unit, the deck structure 24 may instead be split up into several sub-structures (not shown) wherein each one of the sub-structures are floated into position and connected to the hull 10. Additionally, the deck structure 24 may comprise additional equipment, e.g. for drilling, producing or storing hydrocarbons (not shown). Purely by way of example, a deck structure 24 without the additional equipment as presented hereinabove may weigh approximately 10 000 to 20 000 metric tonnes. In a case wherein a deck structure 24 is provided with arrangements for e.g. producing LNG, the deck structure 24, including such arrangements, may weigh 60 000 to 80 000 metric tonnes.

When the deck structure 24 has been placed in position over the hull 10, the two components may be connected to one another to form a semi-submersible unit 26. To this end, the deck structure 24 may be fixedly attached to the hull 10, e.g. by means of welding. Optionally, the deck structure 24 may simply be resting on the hull 10 wherein the deck structure 24 will be held in place in relation to the hull 10 by means of friction forces developed between the two structures.

Figure 4:
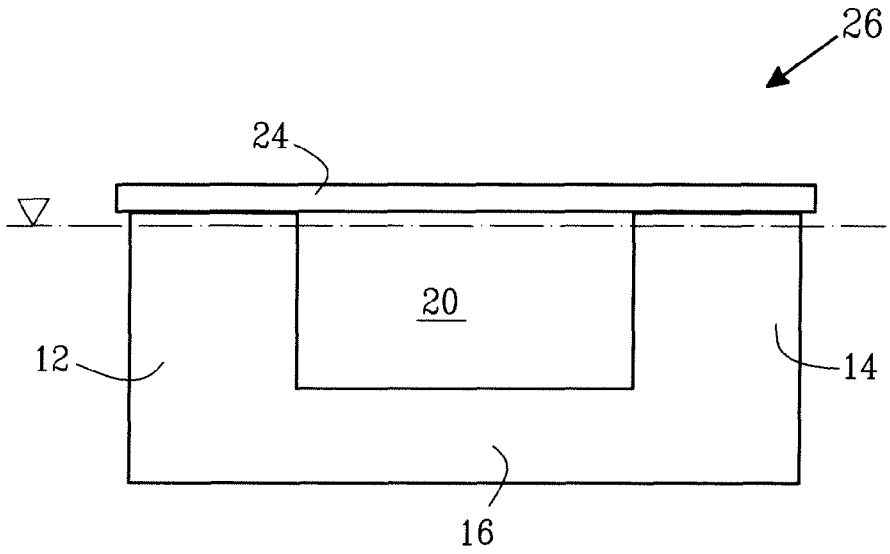
FIG. 4 illustrates a schematic side view of the semi-submersible unit as illustrated in FIG. 3.

FIG. 4 illustrates a side view of the FIG. 3 semi-submersible unit 26. As may be realized when comparing FIG. 4 and FIG. 2, since the FIG. 4 semi-submersible unit 26 comprises the deck structure 24 which is connected to the hull 10 and since the deck structure 24 often is relatively stiff, the deflections of the hull 10 in the FIG. 4 configuration are generally substantially less pronounced than in the case illustrated in FIG. 2. Thus, the configuration as proposed in FIG. 4 provides for that an end piece may be inserted in the first opening 20 in the hull 10 and may also be attached to the hull 10 when the hull 10 subjected to small initial deflections, resulting in a semi-submersible unit with low residual stresses.

Figure 5:
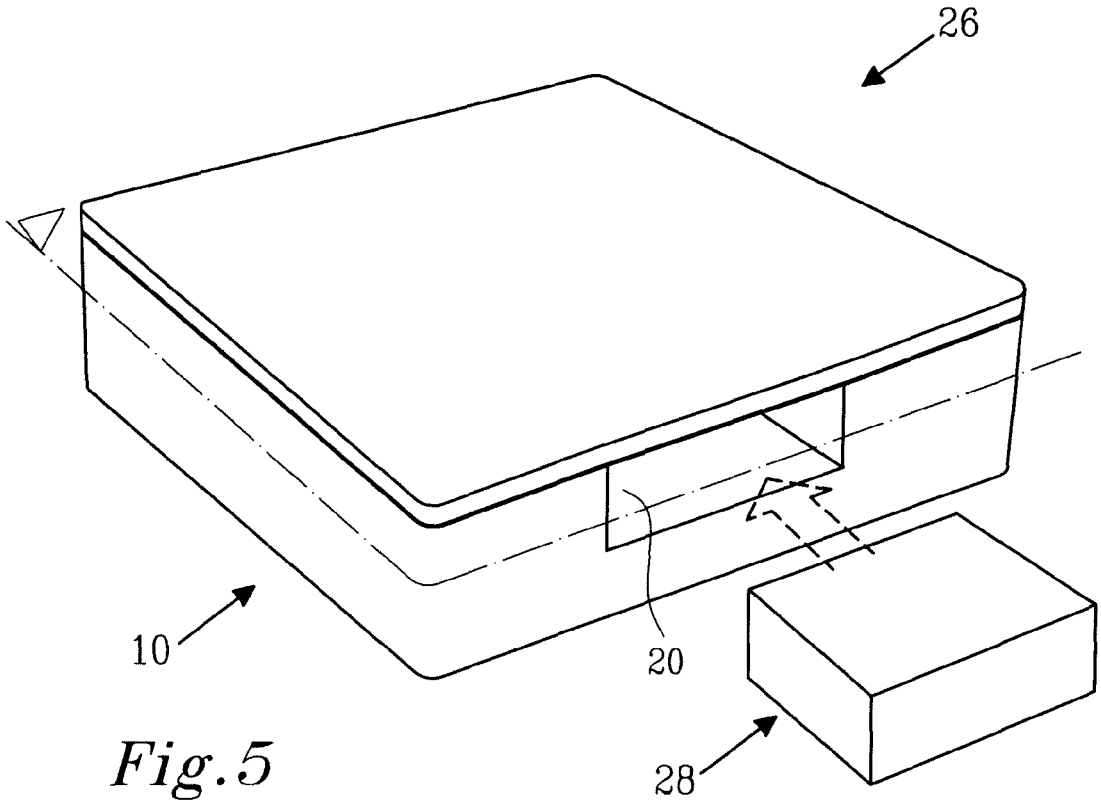
FIG. 5 illustrates a schematic perspective view of the of the semi-submersible unit of FIG. 3, wherein an end piece is floated into the opening of the hull.

FIG. 5 illustrates a perspective view of the semi-submersible unit 26 obtained from the construction step illustrated in FIG. 3. FIG. 5 further illustrates that an end piece 28 may be floated into the opening 20 and connected to the semi-submersible unit 26. In this respect, the draught—i.e. the distance from the bottom of the hull 10 to the still water level—of the semi-submersible unit 26 in the condition illustrated in FIG. 5 is preferably substantially lower than the draught of the hull 10 during the deck structure 24 mating step as illustrated in FIG. 3. This reduction of the draught is carried out order to facilitate the floating in of the end piece 28. However, in some implementations of the construction method of the present invention, it may not be necessary to reduce the draught between the steps of the construction method of the present invention as illustrated in FIG. 3 and FIG. 5. As further may be realized from FIG. 5, the end piece 28 preferably constitutes a substantial part of the side wall. Purely by way of example, the end piece 28 may have a height which is in the interval of 0.2-0.8 of the height of the hull 10 and the width of the end piece 28 may also range from 0.2 to 0.8 of the width or length, whichever is the largest, of the hull 10.

In a preferred implementation of the end piece 28 floating in step of the method of the present invention, the end piece 28 is buoyant such that it may be self-floating into the first opening 20. To this end, the end piece 28 may preferably be connected to an arrangement (not shown) adapted to propel the end piece 28. Purely by way of example, such an arrangement may comprise one or more tugs (not shown). Optionally, if the end piece 28 is not buoyant or if it by some reasons is so desired, the end piece may be loaded on a floating arrangement (not shown) such as a barge (not shown) which floating arrangement in turn may be floated into the first opening 20.

The end piece 28 is preferably made out of steel and preferably comprises structural tanks, such as ballast water tanks (not shown). Such ballast water tanks may be used to control the floating condition of the end piece 28, in the case of a buoyant end piece 28. Moreover, once the end piece 28 has been connected to the semi-submersible unit 26, the ballast water tanks of the end piece 28 may preferably be connected to a ballast water system (not shown) of the semi-submersible unit 26 such that the ballast water tanks of the end piece 28 may be used for controlling the floating condition of the semi-submersible unit 26.

In order to facilitate the floating in of the end piece 28 into the first opening 20; the hull 10 and/or the end piece 28 is preferably provided with guide means for guiding the end piece 28 into position in the first opening 20. Purely by way of example, such a guide means may comprise a rod (not shown) of the hull 10 which rod extends substantially vertically in the first opening 20 as well as two frames (not shown) located on the bottom of the end piece 28, which frames form a tapering gap.

Moreover, the hull 10 may be provided with supports (not shown) located below the opening on which supports the end piece 28 may rest when it has been inserted into the first opening 20.

When the end piece 28 has been inserted into the first opening 20, the end piece 28 and the semi-submersible unit 26 are attached to one another. Preferably, the end piece 28 is fixedly attached to the semi-submersible unit 26, e.g. by means of welding. Moreover, the end piece 28 is preferably fixedly attached to the hull 10 and, if possible, also to the deck structure 24.

Figure 6:
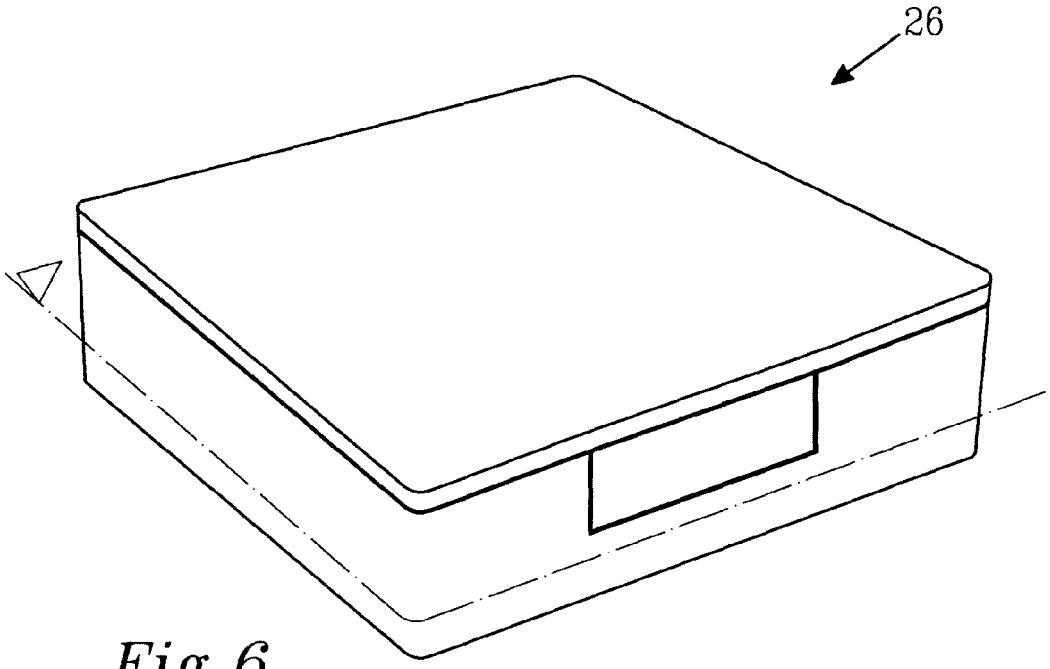
FIG. 6 illustrates a schematic perspective view of the semi-submersible unit in FIG. 3 and FIG. 5, wherein the end piece is being attached to the hull.

The end piece 28 may be attached to the semi-submersible unit 26 when the unit 26 is in the floating condition as illustrated in FIG. 5, e.g. immediately after the end piece 28 has been inserted into the first opening 20. However, in a preferred embodiment of the present invention, the semi-submersible unit 26 is raised—i.e. the draught of the unit 26 is reduced—before the end piece 28 is attached to the unit 26. This implementation of the preferred embodiment is illustrated in FIG. 6. If the end piece 28 is attached to the semi-submersible unit 26 when the unit is in a floating condition as illustrated in FIG. 6, attachment procedures, such as welding, may be performed in a dry environment which generally provides for a more rapid and efficient attachment procedure.

Figure 7:
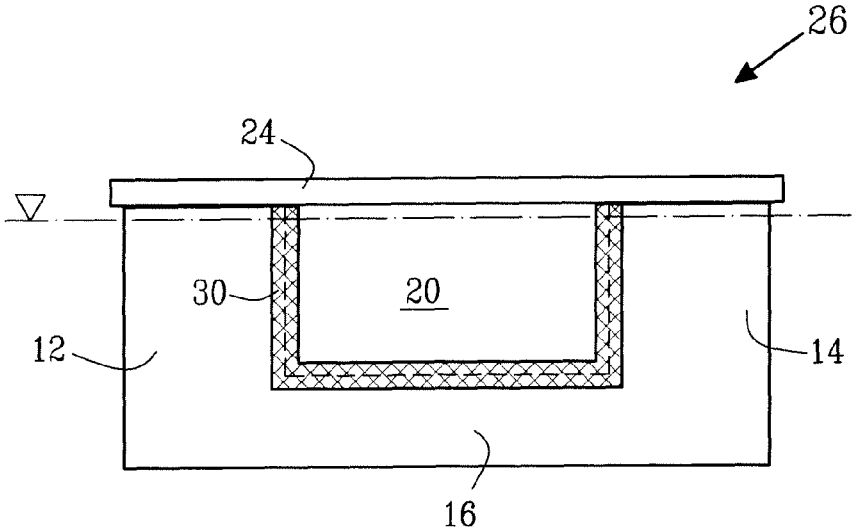
FIG. 7 illustrates a side view of an alternative implementation of a hull suitable for the construction method of the present invention.

FIG. 7 illustrates a side view of another implementation of a hull 10 which may be used in the construction method of the present invention. As may be gleaned from FIG. 7, the hull 10 comprises a truss assembly 30 at least partially delimiting the first opening 20. The truss assembly 30 adds additional structural stiffness without adding any substantial hydrostatic stiffness to the hull 10. As may be realized by a person skilled in the art, the aforementioned changes in the characteristics of the hull 10 obtained by the introduction of the truss assembly 30 may be useful when e.g. performing the construction method of the present invention, for instance as regards deflections of the hull 10 and/or the capability of raising and lowering the hull. With a semi-submersible unit 26 comprising a hull 10 as illustrated in FIG. 7, an end piece (not shown in FIG. 7) is preferably attached to the inner portion of the truss assembly 30.

Figure 8:
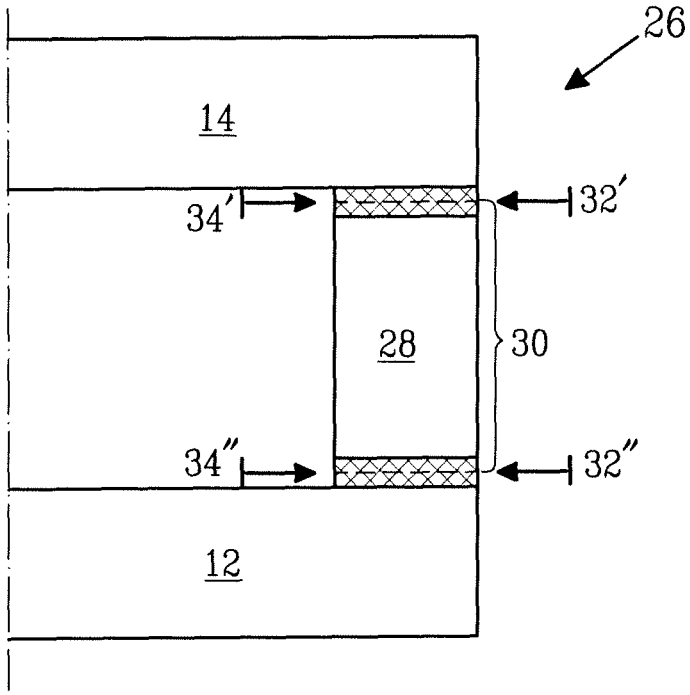
FIG. 8 illustrates a top view of the hull illustrated in FIG. 7.

In order to obtain a buoyant—or at least weather proof—side wall extending from the first float 12 to the second float 14 of the hull 10 as illustrated in FIG. 7, the truss assembly 30 is preferably sealed from ambient water after the end piece 28 has been inserted in the first opening 20 and attached to the truss assembly 30. Preferably, such a sealing is obtained by attaching a sealing arrangement to the truss assembly 30. An example of such a sealing arrangement is illustrated in FIG. 8, wherein the sealing arrangement comprises four steel plates 32', 32", 34' and 34". Each one of the steel plates 32', 32", 34' and 34" is placed in an appropriate position on or over the truss assembly and attached to the hull 10 and the end piece 28. Preferably, the sealing arrangement illustrated in FIG. 8 further comprises a two more plates (not shown in FIG. 8) adapted to be located at each side of the end piece 28 and adapted to cover the portions of the truss assembly 30 located below the end piece 28.

Figure 9:
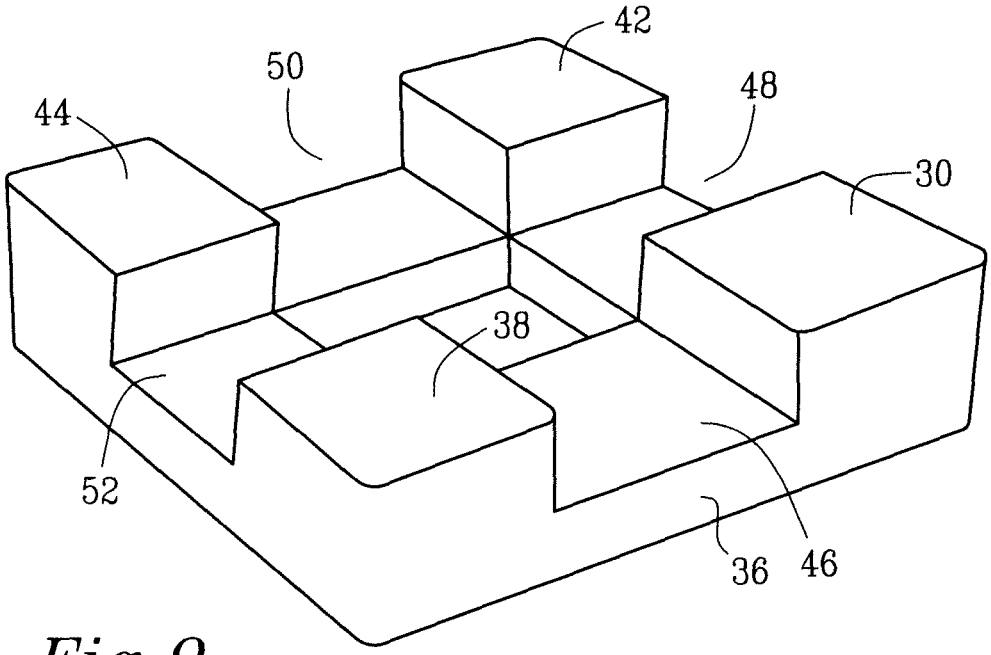
FIG. 9 illustrates a schematic perspective view of yet another hull which may be used in the construction method of the present invention.

Finally, FIG. 9 illustrates another hull 10 for use in the construction method of the present invention may be performed. As may be gleaned from FIG. 9, the hull 10 illustrated therein comprises a ring pontoon 36 and four substantially vertically extending columns 38, 40, 42 and 44 wherein each one of the columns is connected to the ring pontoon 36. As may be realized from FIG. 9, the hull 10 has four openings 46, 48, 50 and 52 and each one of the openings is adapted to receive and end piece (not shown in FIG. 9). Preferably, when all the four openings of a semi-submersible unit, based on the hull 10 illustrated in FIG. 9, have been provided with an end piece, a semi-submersible unit is obtained which has a continuous outer wall, i.e. the unit is of a so called ring wall type.

It should be realized that the present invention is not limited to the embodiments described hereinabove and illustrated in the drawings. Rather, a person skilled in the art will realize that many changes and modifications may be performed within the scope of the appended claims.

The invention claimed is:

1. A method of constructing a semi-submersible unit, comprising;

lowering a hull into a body of water, said body of water having a still water level, and said hull comprising a side wall and an opening for receiving an end piece, wherein said end piece constitutes at least a portion of said side wall;

connecting a deck structure to said hull to form a semi-submersible unit;

floating said end piece into said opening to said still water level in a direction extending generally parallel to said still water level, wherein said hull comprises a truss assembly at least partially delimiting said opening and said step of attaching said end piece to said semi-submersible unit in turn comprises the steps of:

attaching said end piece to said truss assembly, and sealing said truss assembly from ambient water by attaching a sealing arrangement to said truss assembly.

2. The method of according to claim 1, wherein said sealing arrangement comprises a plate.

3. A method of constructing a semi-submersible unit, comprising:

lowering a hull into a body of water, said body of water having a still water level, and said hull comprising a side wall and an opening for receiving an end piece, wherein said end piece constitutes at least a portion of said side wall, wherein said hull comprises a truss assembly at least partially delimiting said opening;

connecting a deck structure to said hull to form a semi-submersible unit;

floating said end piece into said opening to said still water level in a direction extending generally parallel to said still water level; and attaching said end piece to said truss assembly.

4. The method according to claim 3, wherein said method further comprises a step of elevating said semi-submersible unit after said deck structure has been connected to said hull in order to facilitate said floating in of said end piece.

5. The method according to claim 3, wherein said method further comprises a step of elevating said semi-submersible unit after said end piece has been inserted into said opening such that attaching said end piece to said semi-submersible unit may be performed above said still water level of said body of water.

6. The method according to claim 3, wherein said end piece is buoyant such that said end piece may be self-floating into said opening.

7. The method according to claim 3, wherein said end piece is towed into said opening.

8. A kit for constructing a semi-submersible unit adapted to float in a body of water with a still water level, comprising:

a hull comprising a side wall having an opening formed therethrough;

a deck structure; and an end piece adapted to constitute at least a portion of said side wall, and adapted to be floated into said opening and attached to said hull after said deck structure has been attached to said hull and, wherein said hull comprises a first and a second longitudinally extending float, wherein each one of said first and second float is adapted to extend through said still water level of said body of water, wherein said first and second floats are connected to one another by means of a substantially transversally extending bridging arrangement wherein: at least a portion of said first float, at least a portion of said second float and at least a portion of said bridging arrangement at least partially delimits said opening.

9. The kit according to claim 8, wherein said hull comprises a truss assembly at least partially delimiting said opening.

10. The kit according to claim 8, wherein said end piece comprises structural tanks.

11. The kit according to claim 8, wherein said hull comprises tanks adapted to store liquefied natural gas.

12. The kit according to claim 8, wherein said kit comprises a plurality of end pieces such that said side wall delimits an enclosed area.

13. The kit according to claim 8, wherein said end piece comprises ballast water tanks.

14. A method of constructing a semi-submersible unit, comprising:

lowering a hull into a body of water, said body of water having a still water level, and said hull comprising a side wall, an opening for receiving an end piece, and a truss assembly at least partially delimiting said opening, wherein said end piece constitutes at least a portion of said side wall;

connecting a deck structure to said hull to form a semi-submersible unit;

floating said end piece into said opening to said still water level;

attaching said end piece to said truss assembly; and sealing said truss assembly from ambient water by attaching a sealing arrangement to said truss assembly, wherein said sealing arrangement comprises a plate.

15. The method according to claim 14, wherein said method further comprises a step of elevating said semi-submersible unit after said deck structure has been connected to said hull in order to facilitate said floating in of said end piece.

16. The method according to claim 14, wherein said method further comprises a step of elevating said semi-submersible unit after said deck structure has been connected to said hull in order to facilitate said floating in of said end piece.

* * * * *